United States Patent [19]

Thornell et al.

[11] Patent Number: 4,704,743

[45] Date of Patent: Nov. 10, 1987

[54] GLOVE WITH REMOVABLE DIGITS

[76] Inventors: John S. Thornell; Dennis P. Kleinman, both of 921 California Ave., San Jose, Calif. 95125

[21] Appl. No.: 929,531

[22] Filed: Nov. 10, 1986

[51] Int. Cl.[4] ..... A63D 5/00

[52] U.S. Cl. ..... 2/159; 2/161 A; 2/163

[58] Field of Search ..... 2/163, 158, 159, 160, 2/161 R, 161 A

[56] References Cited

U.S. PATENT DOCUMENTS

| | | | |
|---|---|---|---|
| 474,929 | 5/1892 | Tabor et al. | 2/163 |
| 622,688 | 4/1899 | Horn | 2/159 |
| 1,358,824 | 11/1920 | Burden | 2/163 |
| 1,786,227 | 12/1930 | Bruggeman . | |
| 2,118,463 | 5/1938 | Eden | 2/163 |
| 2,318,785 | 5/1943 | Kopplin | 2/158 |
| 2,975,429 | 3/1961 | Newman | 2/159 |
| 3,608,093 | 9/1971 | Kirby | 2/163 |
| 4,081,864 | 4/1978 | Liman | 2/161 A |

*Primary Examiner*—Louis K. Rimrodt

*Attorney, Agent, or Firm*—Townsend & Townsend

[57] ABSTRACT

A glove is provided wherein the thumb portion and index finger portion are separable as a unit from the remainder of the glove by means of a sealing fastener forming a seam between the base of the thumb on the forehand and the base of the thumb on the backhand through an interdigit notch between the index finger and the second finger portions of the glove. The separable portion is provided with means for fastening to the wrist portion of the glove, thereby to expose the thumb and forefinger of the user and to allow full dexterity.

8 Claims, 3 Drawing Figures

GLOVE WITH REMOVABLE DIGITS

BACKGROUND OF THE INVENTION

This invention relates to gloves and more particularly to heavy, insulated gloves as used for snow skiing and other winter sports. However, the applicability of this invention is in any area wherein a heavily insulated glove is used and wherein there is the desire to expose the fingers quickly for brief periods of time.

There is a need, particularly in the winter recreational sports, to provide hand insulation, typically through gloves or mittens, while still permitting the use of the fingers for tasks requiring the joint use of the forefinger and thumb. Heretofore, it has been necessary to remove the gloves in order to expose the forefinger and thumb together. This has several disadvantages. First, the entire hand is exposed to cold unnecessarily. Second, the gloves are readily dropped or lost. The routes under ski lifts are littered with evidence of this problem.

Heretofore, some solutions have been suggested. For example, clips, ties and loops have been provided for attaching gloves to the clothing of the wearer. Of course, pockets are also used. However, this solution is at best limited because of the problems mentioned above. In addition, upon removing a glove, the bulk of the glove may interfere with other activities.

What is therefore needed is a glove which provides the option of partial removal but full exposure of the forefinger-thumb combination which is both convenient to the user and secure against loss.

Gloves with removable digits are known to the art. For example, an early patent to E. Burden, U.S. Pat. No. 1,358,824, patented Nov. 16, 1920, discloses a work glove which has removable fingertips. In this instance, the fingertips are individually buttoned via straps and button holes or loops to the backside of the individual digits. Alternatively, the fingertip covers can be completely removed upon unbuttoning. The Burden invention is limited in that only the fingertips are exposed. Thus, there is interference in the forefinger-thumb joint.

Another patent, issued to A. M. Eden, U.S. Pat. No. 2,118,463, issued May 24, 1938, discloses a shooter's glove wherein zippers are provided in the individual digits to expose opposing margins of the index finger and the thumb. The longitudinally disposed zippers permit the user to expose the extended portions of the index finger and the thumb through slits in adjacent sides of the index finger and thumb portions of the glove. This design permits some limited use of the finger and thumb, for example, for the purpose of discharge of a rifle. The Eden invention has limitations similar to the Burden invention. In addition, the opened glove finger portions interfere with full use of the thumb and forefinger.

Other patents uncovered in the search of the prior art, although of no particular relevance to the present invention, are a patent to A. J. Bruggeman, U.S. Pat. No. 1,786,227, issued Dec. 23, 1930, and to S. Liman, U.S. Pat. No. 4,081,864, issued Apr. 4, 1978. The Bruggeman glove is a combination of a mitten and four-fingered glove wherein the mitten portion is provided with a zipper along its margin allowing it to be removed and then looped onto the backhand of a large work glove. The finger portions are exposed for limited use of the fingers. At no time are the fingers designed to be exposed completely. The mitten portion is designed to be strapped to the backhand of the glove.

The Liman patent discloses a ski glove which is designed for interlocking engagement with a strapless ski pole grip. It is provided with a zipper along the edge of the glove merely to allow the user to open the relative stiff glove for easier access by the hand when entering the glove. Otherwise, the ski glove appears to be conventional.

DESCRIPTION OF THE INVENTION

According to the invention, a glove, particularly a ski glove, is provided wherein the thumb portion and index finger portion are separable as a unit from the remainder of the glove by means of a sealing fastener forming a seam between the base of the thumb joint on the forehand and the base of the thumb joint on the backhand through the interdigit notch between the index finger (forefinger) and the second finger. The sealing fastener is preferably a zipper. The separable portion is joined to the remainder of the glove by a flexible fabric hinge portion across the base of the thumb portion between the ends of the seam. The hinge portion is preferably made of a strong flexible material such as a reinforcing elastic pad integrated into the base of the thumb and the wrist. The zipper terminates on each side of the thumb portion defining a pivot axis in the hinge portion for the removable thumb/index finger portion. The back of the thumb portion is provided with a fastener, preferably a hook-and-eye type of fastener pad which is mated at the opposing end of its pivot path with a mating strip on the hand of the glove at the wrist, thereby to allow the thumb portion to be fastened to the base of the wrist or adjacent to the wrist.

The invention will be better understood by reference to the following detailed description taken in conjunction with the accompanying drawings.

DESCRIPTION OF SPECIFIC EMBODIMENTS

Figure 1:
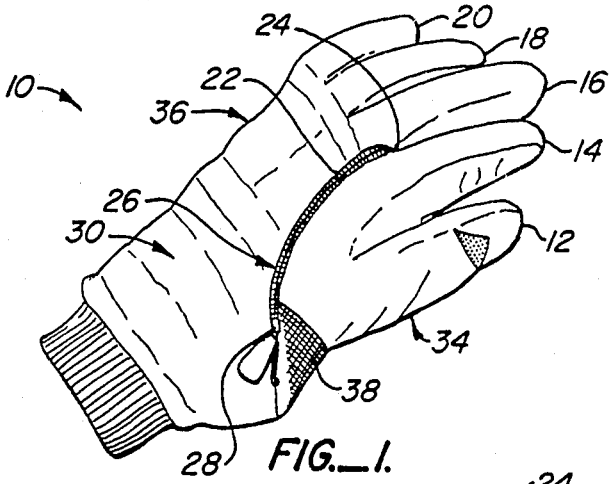
FIG. 1 is a perspective view of a glove in accordance with the invention.
Figure 2:
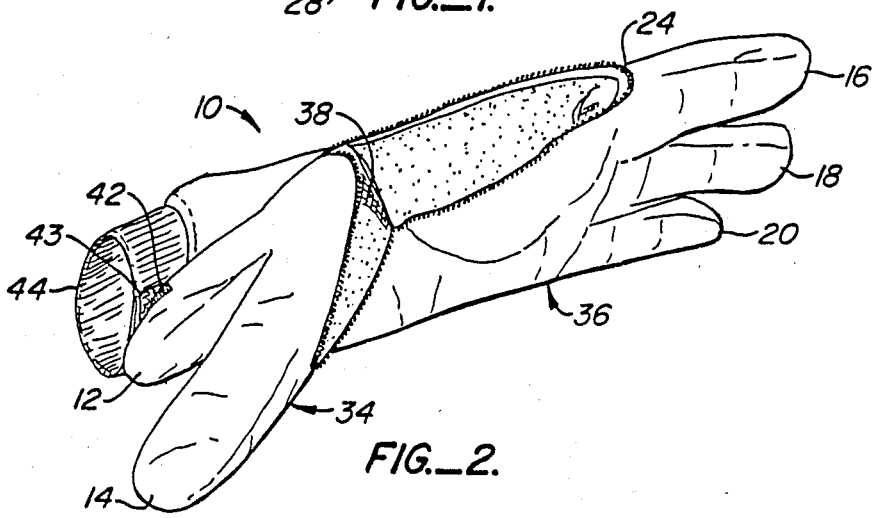
FIG. 2 is a forehand view of the glove according to the invention with the index finger and thumb portions secured to expose the index finger and thumb of a hand.
Figure 3:
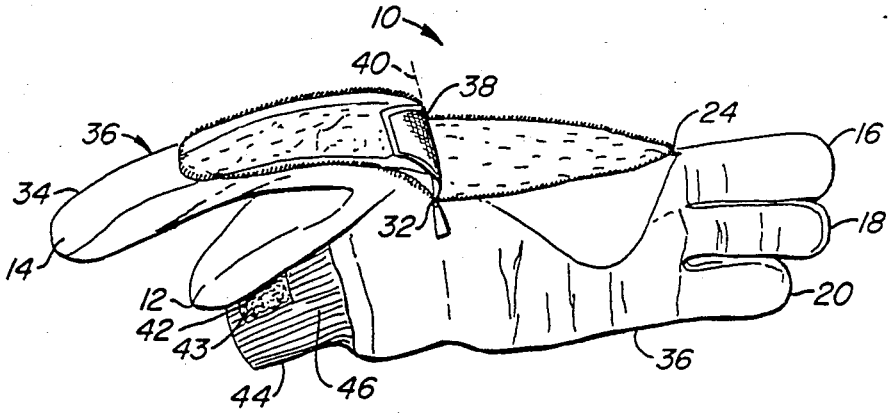
FIG. 3 is a lateral view of a glove showing the hinge portion according to the invention.

Referring to FIGS. 1, 2, and 3, together, there is shown a glove 10 in accordance with the invention. The type of glove depicted is a ski glove. However, the invention is also applicable to other types of gloves suitable for sportsmen, shooters, and construction workers. FIG. 1 shows the glove 10 having a thumb portion 12, a forefinger portion 14, and at least a second finger portion 16, with optional third finger and fourth finger portions 18 and 20. Optionally, the second, third, and fourth finger portions 16, 18, and 20 could be combined in the form of a mitten.

According to the invention, means are provided for separating the thumb portion 12 and the forefinger portion 14 from the remainder of the glove along a seam 22 in the second interdigit notch 24 between the forefinger portion 14 and the second finger portion 16 to expose the thumb, forefinger and first interdigit notch between the thumb and forefinger of a user. Specifically, a sealing fastener 26 is provided along the seam 22, specifically a zipper 26, which extends between the base 28 of the thumb portion 12 on the backhand 30 of the glove 10 through the interdigit notch 24 to the base 32 of the thumb portion 12 on the second forehand.

The thumb portion 12 and forefinger portion 14 thereby define a first segment 34 which is separable as a unit from a second defined segment 36. The first segment 34 is joined to the second segment 36 by means of a flexible fabric hinge portion 38. The flexible hinge portion 38 is preferably constructed of a material sufficiently strong and pliant to withstand flexure throughout the life of the glove 10. Preferably, such a material is a reinforcing elastic pad. The reinforcing elastic pad is integrated into the base of the thumb portion 12. The zipper 26, which is preferably of a corrosion resistant material such a commercially available elastomeric zipper, terminates on each side of the first segment 34 at a position defining a pivot axis 40 for the first segment (FIG. 3). The pivot axis 40, must be disposed sufficiently below the base of the thumb of the user to allow exposure of the user's thumb and forefinger when the first segment 34 is folded back and removed (FIG. 2).

Referring to FIGS. 2 and 3, the first segment 34 is provided with fastener means 42 and 43 whereby the first segment 42 is attached to the wrist portion 44 of the glove 10. The fastener may, for example, be a hook-and-eye type of fastener pad 42 mated with a mating strip 43 on the forearm 46 of the wrist portion 44. The fastener pad 42 may be mounted at approximately the thumbnail position of the thumb portion. A suitable fastener is a Velcro® (3M Corporation of Minneapolis, Minn.). A fastener is important to assure the user with free use of his thumb and forefinger without interference from the first segment.

The invention can be used in two modes: 1) the invention may be used as a conventional insulative glove wherein the first segment 34 is joined to the second segment and sealed along the margin 26. Alternatively, the first segment 34 may be partially separated, i.e., peeled back from the second segment 36 thereby to expose the thumb and forefinger of the user as well as the interdigit notch. The user can then manipulate his exposed thumb and forefinger with full dexterity. In all cases, the first segment may be fastened to the wrist portion in a manner to avoid interference with use of the thumb and forefinger. The first segment 34 is readily restored to its conventional position and the fastener 26 can be resealed.

The invention has now been explained with reference to specific embodiments. Other embodiments will be apparent to those of ordinary skill in the art. Therefore it is not intended that this invention be limited except as indicated by the appended claims.

We claim:

1. A glove having removable digits comprising:

a base portion;

a hinge means;

an attachment means; and a removable digit portion, said removable digit portion comprising at least two complete digit elements of a glove, including a thumb portion, said removable digit portion being attachable to said base portion by means of said attachment means, and said hinge means defining a first margin between a forehand portion of the glove and a backhand portion of the glove across a back of the thumb portion, said attachment means defining a second margin between the base portion and the digit portion along the forehand portion and the backhand portion through an interdigit notch of the glove, the attachment means terminating at the hinge means.

2. The glove according to claim 1 wherein said attachment means comprises a zipper having a track and a closure, said closure having a fob.

3. The glove according to claim 2 wherein said fob is of sufficient size to be gripped by a gloved hand.

4. The glove according to claim 3 wherein the zipper track terminates at the base of the forehand thumb portion and at the base of the backhand thumb portion in a loop through the interdigit gap.

5. The glove according to claim 4 wherein the hinge means is formed of a flexible reinforcing material.

6. The glove accoridng to claim 1, 4 or 5 further including a first fastening means disposed to the backside of the thumb portion and a second fastening means disposed upon the wrist portion of the glove mating said first fastening means, said first fastening means disposed to abut and engage said second fastening means when said digit portion is bent back for retaining the removable glove portion in position whenever the removable digit portion is pulled away from the base portion.

7. The glove according to claim 6 wherein said first fastening means and said second fastening means comprise hook and eye adhesion means.

8. The glove according to claim 1, 4 or 5 wherein the second margin is disposed along a line extending between the base portion of the forehand and the base portion of the backhand of the thumb portion through the interdigit gap between the index finger and the second finger portions.

* * * * *